United States Patent [19]

Avery et al.

[11] 3,953,098

[45] Apr. 27, 1976

[54] LOCKING ELECTRICAL CONNECTOR

[75] Inventors: Roger Peter Avery, Bethel; William Max Erich Zerlin, Newtown, both of Conn.

[73] Assignee: Bunker Ramo Corporation, Oak Brook, Ill.

[22] Filed: Feb. 1, 1974

[21] Appl. No.: 429,798

Related U.S. Application Data

[63] Continuation of Ser. No. 257,639, May 30, 1972, abandoned.

[52] U.S. Cl. ..... 339/45 R; 339/91 R; 339/177 R

[51] Int. Cl. ..... H01r 13/54

[58] Field of Search ..... 339/45, 75, 91, 177; 285/277, 305, 315–317

[56] References Cited

UNITED STATES PATENTS

| | | | |
|---|---|---|---|
| 2,425,992 | 8/1947 | Cadwallader | 285/316 X |
| 2,983,893 | 5/1961 | Jackson | 339/177 R X |
| 3,051,925 | 8/1962 | Felts | 339/177 R X |
| 3,336,562 | 8/1967 | McCormick et al. | 339/91 R X |
| 3,452,316 | 6/1969 | Panek et al. | 339/45 M |
| 3,594,694 | 7/1971 | Clark | 339/45 M |
| 3,684,321 | 8/1972 | Hundhausen et al. | 285/316 |

*Primary Examiner*—Roy D. Frazier
*Assistant Examiner*—Terrell P. Lewis
*Attorney, Agent, or Firm*—D. R. Bair; F. M. Arbuckle

[57] ABSTRACT

This invention relates to a locking electrical connector which is particularly adapted for lanyard release. The connector has a first contact with an annular inner projection. This contact is adapted for expansion to enlarge the diameter of the inner projection when a mating second contact or jack is being inserted or removed from the contact. A locking collar is mounted for movement between a first position over the first contact, preventing the expansion thereof, and a second position in which the collar does not inhibit the expansion of the contact. The locking collar is normally biased to the first position. The second contact or jack has an annular outer groove and is dimensioned to be seated in the first contact with the annular projection of the first contact in the annular groove of the second contact when the contacts are fully mated. For a preferred embodiment, a lanyard is secured to the locking collar and is adapted, when a suitable axial force is applied to it, to move the locking collar from the first to the second position.

1 Claim, 4 Drawing Figures

LOCKING ELECTRICAL CONNECTOR

This is a continuation, of application Ser. No. 257,639, filed May 30, 1972 now abandoned.

This invention relates to a locking electrical connector for coaxial cable and more particularly to an electrical connector of this type which is adapted for lanyard release.

BACKGROUND OF THE INVENTION

There are numerous applications where a requirement exists for a locking cable connector, the two portions or elements of which cannot be separated regardless of the force applied to the cable (i.e. the force required to separate the connector elements being greater than the force required to break the cable or connector) when the connector is in a locked condition. The connector should, however, have a simple unlocking mechanism which, when operated, permits the elements to be easily separated. In one such application, an element which is to be dropped from, for example an airplane, is not to have its electrical connection with the carrier broken as a result of normal shocks, vibration or the like, but is to have this connection easily broken when the element is dropped. For such an application, the lock releasing element may be connected to and operated by a lanyard which is pulled to operate the release mechanism when the device is dropped.

While a limited number of connectors adapted for operation as indicated above are presently available, these connectors have generally been relatively bulky, complex and expensive. Some, while easily releasable, have been subject to possible improper mating or have been difficult to mate. This is particularly true in at least one connector where the mating operation works against the release mechanism, making mating difficult in applications where a high release force is required. Standard locking connectors normally utilize a screw thread or other mechanism requiring a twisting action for connect or disconnect. Such a mechanism is, however, incompatible with lanyard release which requires a pulling action for disconnect. Further, the complexity of existing locking connectors makes it difficult to miniaturize these connectors for critical space applications.

A need therefore exists for a simple, compact, low cost locking electrical connector which may be easily and accurately mated, while being adapted for pulling action lanyard release. The force required for release should be easily adjustable over a wide range without adversely effecting the mating operation.

SUMMARY OF THE INVENTION

In accordance with the above, this invention provides a locking electrical connector having a first contact with an annular inner first distortion such as a projection. This contact is adapted for expansion to enlarge the diameter of the inner first distortion (projection) when a mating second contact or jack is being inserted or removed from the contact. For a preferred embodiment, the first contact is a tubular member which is slotted to form a plurality of resilient fingers. A locking collar is mounted for movement between a first position over the first contact, preventing the expansion thereof, and a second position in which the collar does not inhibit the expansion of the contact. The locking collar is normally biased by a suitable means to the first position. The second contact or jack has an annular outer second distortion such as a groove and is dimensioned to be seated in the first contact with the first and second distortion fitted together (i.e. with the annular projection of the first contact in the annular groove of the second contact) when the contacts are fully mated. For a preferred embodiment, a lanyard is secured to the locking collar and is adapted, when a suitable force is applied to it, to move the locking collar from the first to the second position. From the above it is apparent that, with the elements mated and the locking collar in its first position, it is impossible to separate the connector elements. However, the connector elements may be easily connected or disconnected when the locking collar is slide to its second position.

The foregoing and other objects, features and advantages of the invention will be apparent from the following more particular description of a preferred embodiment of the invention as illustrated in the accompanying drawings.

DETAILED DESCRIPTION

Figure 1:
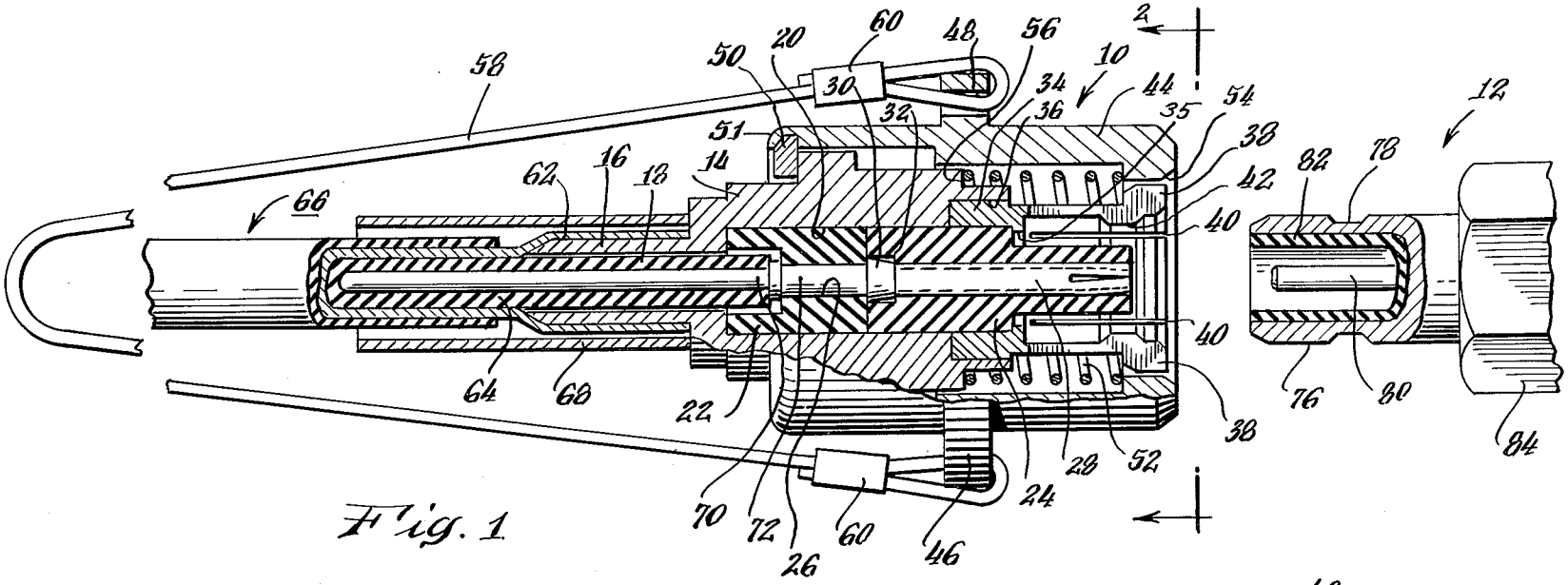
FIG. 1 is a partially cut-away side view of a pair of connector elements of this invention showing the elements in an unmated condition.
Figure 2:
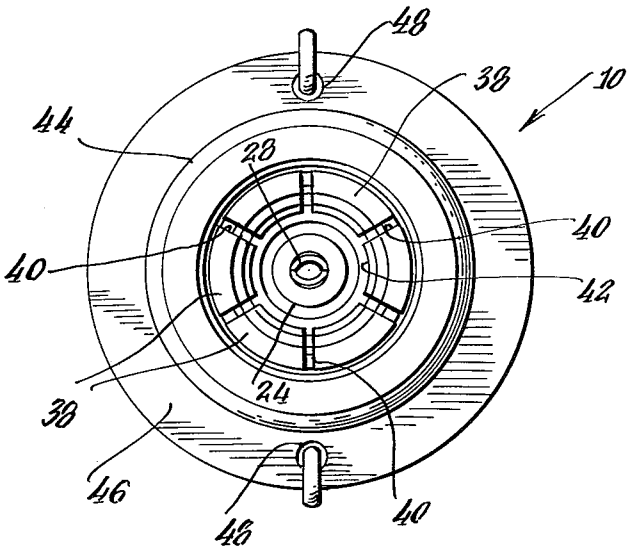
FIG. 2 is a view of one of the connector elements taken along the line 2—2 of FIG. 1.

Referring now to the figures, it is seen that the connector for a preferred embodiment of the invention consists of a female connector element 10 and a male connector element or jack 12. Connector element 10 consists of a connector body 14 having a tapered rear sleeve 16 of reduced diameter and a center bore 18 with an enlarged counterbore 20. Positioned in counterbore 20 is a first block of insulating material 22 and a second block of insulating material 24. Blocks 22 and 24 have aligned bores 26 in which a female center contact 28 is positioned. A locking flange 30 on center contact 28 coacts with a counterbore 32 in block 24 to hold center contact 28 in place. A conductive ring 34 is press fitted in a forward counterbore 36 of body 14 and has an inwardly extending flange 35 which retains insulating block 24 in the body 14. The ring 34 has a tubularshaped forward extension constituting outer contact 38. Slots 40 in contact 38 divide the contact into fingers which may be separated to expand the diameter of the contact. Contact 38 also has an inner annular ridge or projection 42.

Figure 4:
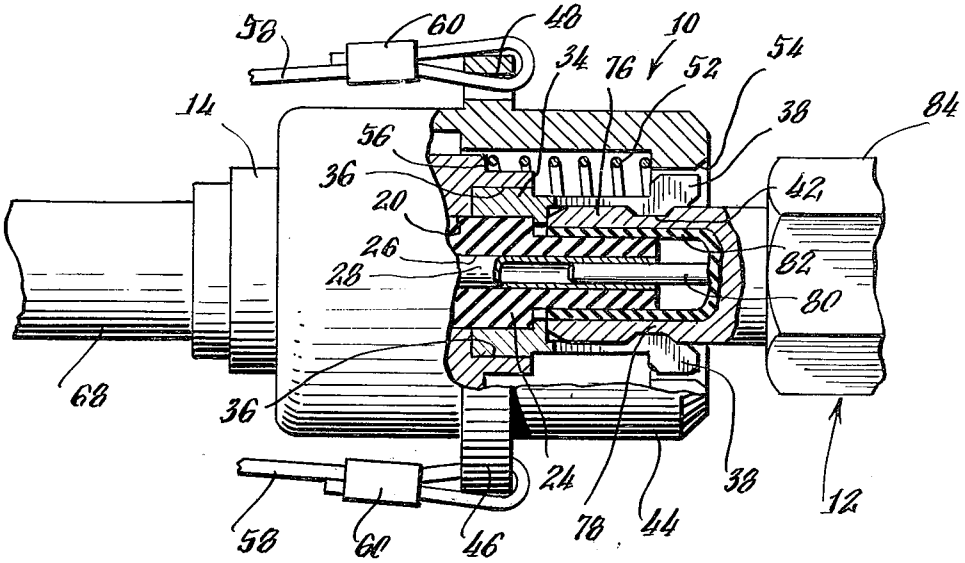
FIG. 4 is a partially cut-away side view of the connector elements of FIG. 1, showing the elements in a fully mated condition.

A locking collar or sleeve 44 having a flange 46 with a pair of holes 48 formed therein is mounted for sliding movement on body 14. A metal washer 50 coacts with a rolled-over flange 51 on collar 44 to hold the collar on body 14. Collar 44 is normally biased in the position shown in FIGS. 1 and 4 by a compression spring 52 captivated between an overhanging lip 54 of collar 44 and a shoulder 56 of body 14. With the collar in this position, lip 54 is adjacent the fingers of contact 38 and prevents the fingers from being expanded. A wire cable lanyard 58, preferably formed of stainless steel, has both of its ends formed into loops passing through holes 48, the loops being secured with crimp splices 60.

Sleeve 16 of body 14 is wedged between outer conductor 62 and insulator 64 of coaxial cable 66. The cable is held on sleeve 16 by crimp ferrule 68. Center conductor 70 of the coaxial cable passes into a hole in center contact 28 and is secured therein by a drop of solder 72 which passes through a hole in the center contact.

Male or jack element 12 consists of an outer contact 76 which is dimensioned to fit into outer conductor 38 of element 10. Contact 76 has an annular groove 78 formed in it. Jack 12 also has a male center contact 80 which is separated from contact 76 and supported therein by an insulating block 82. The contacts 76 and 80 may be connected to the outer and center conductors respectively of a coaxial cable (not shown) in much the same manner that contacts 38 and 28 of connector element 10 are connected to the conductors of cable 66. However, for the preferred embodiment of the invention, these contacts are connected as part of an adapter, the other end 84 of which is constructed to mate with a standard coaxial connector element.

In operation, when elements 10 and 12 are to be connected or mated, they are initially positioned as shown in FIG. 1. Collar 44 is then slide back to the position shown in FIG. 3. This may be accomplished by either pulling back directly on flange 46 with for example a thumb and forefinger, or by pulling back on lanyard 58. This moves projection 54 back behind the fingers of contact 38, permitting these fingers to be expanded. Jack 12 is then pushed into contact 38. Since the forward portion of contact 76 is larger than rib 42, the fingers of contact 38 expand to permit this portion of the jack to pass (see FIG. 3). When groove 78 comes adjacent to rib 42, the contact elements are fully mated and the resilient fingers are permitted to snap back to their initial position with rib 42 seated in groove 78 to hold the elements together. Collar 44 is then released and returns under the action of spring 52 to its normal position (see FIG. 4) preventing the fingers of contact 38 from again being expanded and thus effectively locking the contact elements together.

Figure 3:
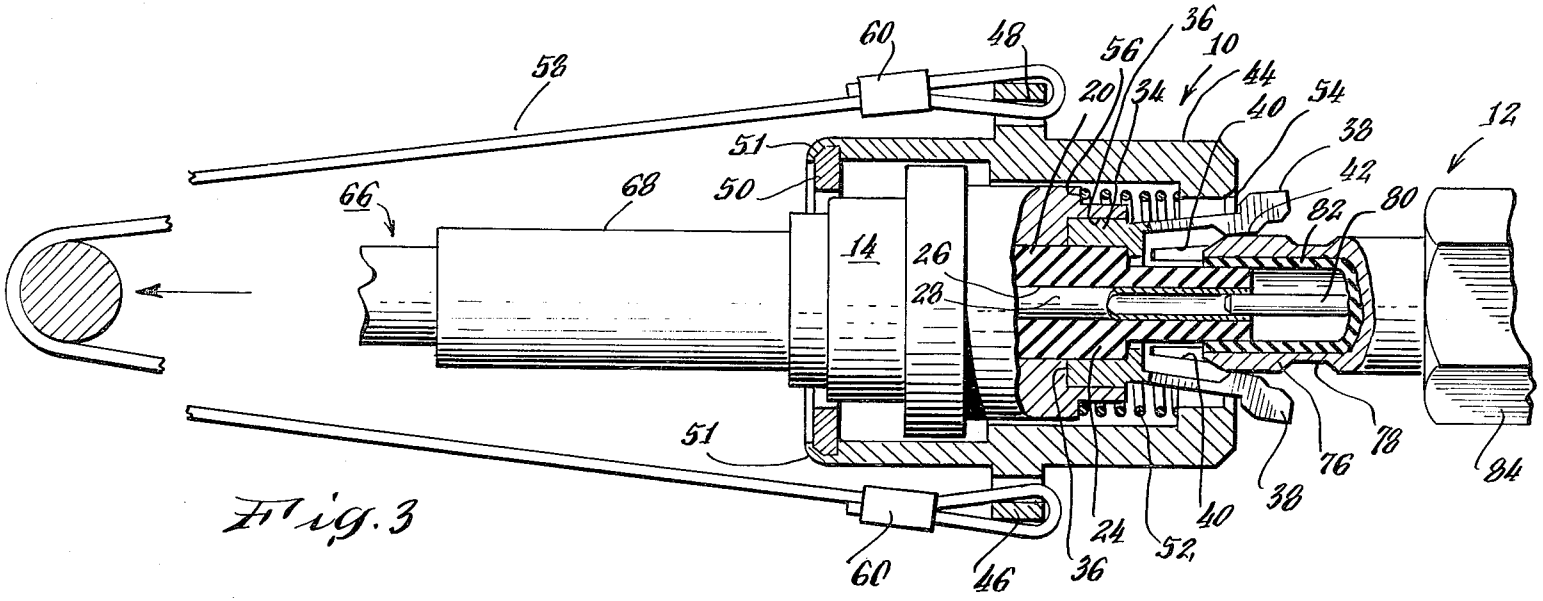
FIG. 3 is a partially cut-away side view of the connector shown in FIG. 1, showing the elements in a partially mated or partially unmated condition.

To disconnect connector elements 10 and 12, collar 44 is again retracted by applying an axial force either directly to flange 46 or to lanyard 58. With the collar retracted, permitting the fingers of contact 38 to again expand, the contact elements may be easily separated by an axial force on either element 10, element 12, or both. FIGS. 3 and 1, in that order, illustrate the sequence of operations for the disconnect.

Since the retracting of collar 44 is independent of either the connect or disconnect operations, the compression force for spring 52 may be selected solely on the basis of the desired release force. Further, since a simple design requiring a minimum of parts is provided, the connector may be easily miniaturized for use in areas where space is restricted. The simplicity of design also minimizes both the cost of parts and assembly. The objects of positive locking without threads, disconnect with a pulling motion so as to facilitate lanyard release, and elimination of twisting actions during connect are also achieved.

While in the discussion above a specific connector design has been illustrated, it is apparent that various changes in form and details could be made in the connector and in the various elements thereof by one ordinarily skilled in the art while still remaining within the spirit and scope of the invention.

What is claimed is:

1. A locking electrical connector comprising a tubular electrically conductive body, a block of insulating material carried therein, at least one contact member carried in said block, a tubular outer contact member press fitted in one end of said body and abutting against said block to retain it in said body, fingers on the forward portion of said contact member, the extremities of said fingers being outwardly flexible to expand the diameter of the contact, an inwardly directed projection adjacent the outer end of each finger, adapted to coact with complementarily shaped surfaces on a mating connector, and a longitudinally movable sleeve mounted on said body, said sleeve being movable to a position where it surrounds the outer ends of said fingers, the inner diameter of said sleeve being sized to prevent expansion of the diameter of said contact when said sleeve is in said surrounding position.

* * * * *